US010113509B2

(12) United States Patent
Sakurai et al.

(10) Patent No.: US 10,113,509 B2
(45) Date of Patent: Oct. 30, 2018

(54) CARBURETOR FOR INTERNAL COMBUSTION ENGINE

(71) Applicant: HONDA MOTOR CO., LTD., Tokyo (JP)

(72) Inventors: Koichi Sakurai, Wako (JP); Masaki Ando, Wako (JP); Eiichi Utsugi, Wako (JP); Hitoshi Abe, Wako (JP); Takashi Suzuki, Wako (JP); Katsuya Tajima, Wako (JP); Masayuki Fukuhara, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 148 days.

(21) Appl. No.: 15/197,911

(22) Filed: Jun. 30, 2016

(65) Prior Publication Data

US 2017/0002769 A1 Jan. 5, 2017

(30) Foreign Application Priority Data

Jul. 1, 2015 (JP) ..... 2015-132660

(51) Int. Cl.
*F02M 11/10* (2006.01)
*F02M 7/26* (2006.01)

(52) U.S. Cl.
CPC ..... *F02M 7/26* (2013.01)

(58) Field of Classification Search
CPC ..... F02M 69/044; F02M 17/04; F02M 23/03; F02M 23/08; F02M 19/04; F02M 1/00;
(Continued)

(56) References Cited

U.S. PATENT DOCUMENTS 2,863,434 A * 12/1958 Holley, Sr. ..... F02M 7/02 123/533
3,549,133 A * 12/1970 Frankowski ..... F02M 7/133 261/51

(Continued)

FOREIGN PATENT DOCUMENTS

DE 3008652 A1 * 9/1980 ..... F02D 31/005
GB 111525 A * 11/1917 ..... F02M 1/00

(Continued)

OTHER PUBLICATIONS

Japanese Office Action issued in connection with Japanese Patent Application No. 2015-132660, dated Feb. 7, 2017, 4 pgs.

*Primary Examiner* — Marguerite McMahon
*Assistant Examiner* — Tea Holbrook
(74) *Attorney, Agent, or Firm* — Armstrong Teasdale LLP

(57) ABSTRACT

In an automotive carburetor, the time delay in the response of the engine to the change in the cross sectional area of the air passage is minimized, and a high level of freedom in selecting the communication cross section area of the air passage and the air fuel ratio for the given load of the engine. The carburetor (1) comprises a fuel passage (13) including a fuel nozzle (16) for supplying fuel to the intake passage, a first air passage (14) communicating with the fuel passage to supply air to the fuel passage, a variable communication unit (21, 41) provided in a part of the first air passage and moveable between an open position for communicating the first air passage and a closed position for shutting off the first air passage and a switch mechanism (22, 43) for moving the variable communication unit between the open position and the closed position in dependence on a load of the engine.

8 Claims, 11 Drawing Sheets

(58) Field of Classification Search
CPC ..... F02M 13/046; F02D 2009/0272; F02D 2200/0406; F02D 2200/0404
USPC ..... 261/44.1–44.7, 54–58, 119.2, DIG. 1, 261/DIG. 36, DIG. 52; 123/525, 123/698–704, 437–439
See application file for complete search history.

(56) References Cited

U.S. PATENT DOCUMENTS 3,575,152 A * 4/1971 Wentworth ..... F02M 25/089 123/520
4,106,471 A * 8/1978 Nakajima ..... F02D 17/02 123/193.5
4,163,434 A * 8/1979 Tsukamoto ..... F02M 23/08 123/587
4,198,940 A * 4/1980 Ishida ..... F02D 17/02 123/198 F
4,216,758 A * 8/1980 Yoshioka ..... F02D 17/02 123/198 F
4,224,914 A * 9/1980 Knapp ..... F02M 69/08 123/452
4,240,395 A * 12/1980 Simko ..... F02D 1/025 123/382
4,284,056 A * 8/1981 Sugasawa ..... F02D 17/02 123/198 F
4,449,496 A * 5/1984 Mokuya ..... F02D 17/02 123/198 F
4,481,914 A * 11/1984 Ishida ..... F02M 1/16 123/179.16
4,558,680 A * 12/1985 Nakazato ..... F02D 23/00 123/437
4,681,078 A * 7/1987 Noguchi ..... F02M 23/04 123/490
6,131,890 A * 10/2000 Fischer ..... F02M 3/08 261/35
8,915,231 B2 * 12/2014 Raasch ..... F02D 31/00 123/363
2010/0176519 A1 * 7/2010 Omarsson ..... F02D 11/04 261/44.2

FOREIGN PATENT DOCUMENTS

JP S6110959 U 1/1986
JP H01130048 A 5/1989
JP H04318263 A 11/1992
JP H09112348 A 4/1997
JP 2004137928 A 5/2004
JP 2014077367 A 5/2014

* cited by examiner

CARBURETOR FOR INTERNAL COMBUSTION ENGINE

TECHNICAL FIELD

The present invention relates to a carburetor for an internal combustion engine that can change the flow rate of air that is supplied to a fuel passage, thereby adjusting the air fuel ratio of the mixture depending on the load of the engine.

BACKGROUND ART

The air fuel ratio of the mixture for an internal combustion engine is often controlled in dependence on the load with the aim of improving the emission property of the engine. The air fuel ratio can be adjusted by using an electronically controlled fuel injection system or by controlling the fuel jet of a carburetor with a solenoid valve.

The electronically controlled fuel injection system requires electricity from the time of start up, and has the disadvantage of requiring a control unit which is bulky and expensive. When the fuel jet is controlled by using a solenoid valve, substantially less cost is required as compared to the electronically controlled fuel injection system, but the flow rate of fuel is required to be controlled at a high precision. Because the flow rate of fuel is extremely small, it is highly difficult to achieve a desired level of precision.

A proposal has been made to address this problem without using an electronic controller by providing a carburetor that can adjust the air fuel ratio with a mechanical arrangement. According to this proposal, the carburetor is provided with a first and second air passage that are communicated with an air bleed chamber for feeding air to the fuel passage (nozzle), and a cutaway is formed in the throttle shaft so that the second air passage is communicated with the air bleed chamber via this cutaway. The cutaway is configured such that the cross sectional area of the second air passage is narrowed, and the air fuel ratio is reduced owing to the reduction in the supply of air to the air bleed chamber when the throttle opening is great (when the engine load is great). See JP2004-137928A, for instance.

However, in the carburetor proposed in this patent document, the length of the flow passage from the inlet of the second air passage to the air bleed chamber is so great that a significant time delay is inevitable from the time the second air passage is narrowed until the time the air fuel ratio is actually changed. Furthermore, because of the need to form a cutaway in the throttle shaft, the diameter of the throttle shaft is required to be increased in view of ensuring an adequate cross sectional area for the second air passage. For the given size of the carburetor, increasing the diameter of the throttle shaft results in the reduction in the cross sectional area of the throttle valve with the result that the engine output property is adversely affected. Therefore, the cutaway has to be increased in size in view of ensuring an adequate cross sectional area of the second air passage so that the freedom in the configuration and positioning of the cutaway is impaired. Therefore, it is highly difficult to achieve both an adequate cross section area of the second air passage and a favorable response property of the engine at the same time.

SUMMARY OF THE INVENTION

The present invention was made in view such problems of the prior art, and has a primary object to provide a carburetor that can adjust the air fuel ratio by varying the flow rate of air depending on the load of the engine by using a highly simple structure.

A second object of the present invention is to provide a carburetor that can minimize the time delay in the response of the engine to the change in the cross sectional area of the air passage.

A third object of the present invention is to provide a carburetor that allows a high level of freedom in selecting the air fuel ratio for the given load of the engine.

MEANS FOR ACCOMPLISHING THE TASK

To achieve at least a part of such objects, the present invention provides a carburetor (1) for an internal combustion engine, comprising, a throttle body (2) internally defining an intake passage (3); a throttle valve (5) provided in the intake passage for controlling a flow rate of air conducted by the intake passage; a fuel passage (13) including a fuel nozzle (16) for supplying fuel to the intake passage; a first air passage (14) communicating with the fuel passage to supply air to the fuel passage; a variable communication unit (21, 41) provided in a part of the first air passage and moveable between an open position for communicating the first air passage and a closed position for shutting off the first air passage; and a switch mechanism (22, 43) for moving the variable communication unit between the open position and the closed position in dependence on a load of the engine.

According to this arrangement, a mechanism for adjusting the air fuel ratio by changing the flow rate of air in the first air passage can be realized by using a highly simple structure. Because the variable communication unit actuated by the switch mechanism is provided in a part of the intake passage upstream of the throttle valve, the length of the flow passage of the first air passage can be minimized, and the delay in the response of the air fuel ratio can be minimized. Furthermore, a mechanism for adjusting the air fuel ratio can be realized in such a manner that overall structure is simplified, and a high level of freedom in the layout design regarding the positioning and the size of the variable communication unit can be attained without being limited by the position of the throttle valve and the diameter of the throttle shaft. Thereby, the cross sectional area of the air passage and the switch property can be freely determined.

In this invention, the switch mechanism (22, 43) may be configured to move the variable communication unit (21, 41) to the closed position in a high load operating condition of the engine, and to the open position in a low to medium load operation condition.

According to this arrangement, in the high load operating condition, the air fuel ratio can be enriched by terminating the supply of air from the first air passage to the fuel passage, and the reduction in the engine output can be avoided.

In this invention, the carburetor may comprise a second air passage (15) communicating with the fuel passage (13) to supply air to the fuel passage independently from the first air passage (14).

According to this arrangement, even when the first air passage is shut off by the variable communication unit, air can still be supplied from the second air passage to the fuel passage, and the atomization of the fuel can be promoted. Because the air is supplied to the fuel passage via the second air passage at all times, even when there is an error in the communication cross section of the first air passage and/or the switch property, the impact of such an error on the air fuel ratio can be minimized. Therefore, the working precision or the operating precision of the variable communication unit is not required to be particularly high, and the manufacturing cost can be reduced.

In this invention, the variable communication unit may include an air passage shaft (21) received in a retaining hole (23) provided in an intermediate part of the first air passage (14) in a rotatable manner around an axial line extending in parallel with a shaft (7) of the throttle valve (5), the air passage shaft being provided with a cutaway so that a communication passage (27) defined by the cutaway changes in a cross sectional area in dependence on an angular position of the air passage shaft.

According to this arrangement, the air passage shaft rotates in response to the throttle opening via the link mechanism such that the first air passage is communicated when the throttle opening is small, and the first air passage is shut off when the throttle opening is great, and this structure can be realized in a relatively simple manner with a high level of freedom in laying out the various components.

In this invention, the switch mechanism may comprise a link mechanism (22) coupled between the throttle shaft (7) and the air passage shaft (21) such that the first air passage (14) is communicated when an opening angle of the throttle valve is small, and is shut off when the opening angle of the throttle valve is great.

Thereby, the switch mechanism can be formed as a highly simple mechanical structure.

In this invention, the link mechanism (22) may include an eccentric pin (25*b*) provided on one of the throttle shaft (7) and the air passage shaft (21), and an arm (26) provided on the other of the throttle shaft and the air passage shaft and having a slot (26*a*) receiving the eccentric pin.

Thereby, the link mechanism can be formed as a highly simple structure.

In this invention, the link mechanism (22) may comprise a rod (32) connected eccentrically and pivotally to one of the throttle shaft (7) and the air passage shaft (21) at one end thereof, and an arm plate (33) provided on the other of the throttle shaft and the air passage shaft and having a slot (33*a*) receiving an eccentric pin (32*b*) provided on another end of the rod (32).

Thereby, even when the air passage shaft is located at some distance from the throttle shaft, the link mechanism for actuating the air passage shaft can be formed as a highly simple structure.

In this invention, the variable communication unit may include a diaphragm (41) separating a pressure chamber (42) from a part of the first air passage (14) in such a manner that the diaphragm communicates the first air passage when the pressure chamber is under negative pressure and shuts off the first air passage when the pressure chamber is substantially under the atmospheric pressure, and the switch mechanism may include a negative pressure passage (43) having an end communicating with the intake passage at a point immediately downstream of the throttle valve and another end communicating with the pressure chamber.

According to this arrangement, owing to the action of the diaphragm which responds to the negative pressure applied thereto via the negative pressure passage, the first air passage is communicated when the throttle opening is small, and the intake negative pressure is significant, and the first air passage is shut off when the throttle opening is great, and the negative pressure is insignificant. Furthermore, this arrangement can be realized in a simple manner with a high level of layout freedom.

According to the present invention, a mechanism for controlling the air fuel ratio by changing the flow rate of air depending on the load of the engine can be formed by using a highly simple structure. Also, the time delay in the change of the air fuel ratio caused by the switching of the air passage can be minimized, and the communication cross sectional area of the air passage and the switching property can be selected with a high level of freedom.

BRIEF DESCRIPTION OF THE DRAWING(S)

DESCRIPTION OF THE PREFERRED EMBODIMENT(S)

Preferred embodiments of the present invention are described in the following with reference to the appended drawings.

First Embodiment

Figure 1:
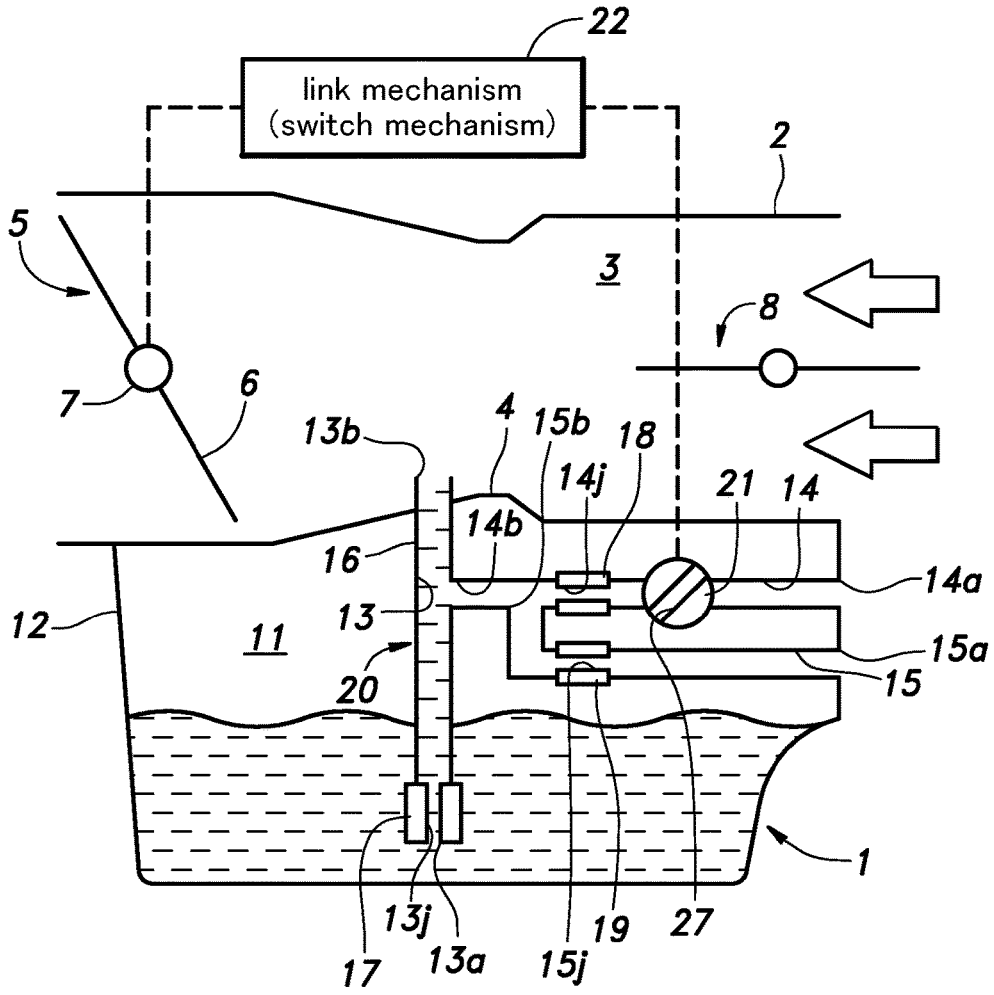
FIG. 1 is a simplified diagram of a carburetor given as a first embodiment of the present invention.

A carburetor 1 embodying the present invention is described in the following with reference to FIGS. 1 to 7. FIG. 1 is a simplified diagram of the carburetor 1 of an internal combustion engine incorporated with a throttle body 2. The throttle body 2 is an intake passage member defining a part of an intake passage 3 for supplying air to the engine, and is provided with a venturi 4 in an intermediate part thereof. The venturi 4 consists of a narrowed section of the intake passage. The pressure in the venturi 4 is lower than the upstream part or the downstream part of the intake passage 3 owing to the increased velocity of the intake air.

A throttle valve 5 for adjusting the cross sectional area of the intake passage 3 is provided in a part of the throttle body 2 downstream of the venturi 4. The throttle valve 5 includes a disk-shaped valve member 6 having a shape corresponding to the cross section of the intake passage 3 and a valve shaft or a throttle shaft 7 supporting the valve member 6. The throttle shaft 7 is rotatably supported by the throttle body 2.

A choke valve 8 having a similar configuration as the throttle valve 5 is provided in a part of the throttle body 2 upstream of the venturi 4. The choke valve 8 opens the intake passage 3 during normal operation of the engine, and chokes off the intake passage 3 at the time of cold startup for increasing the negative pressure in the venturi 4 and enriching the mixture of the fuel and the intake air (or reducing the air fuel ratio A/N) so that the engine startup may be facilitated.

The carburetor 1 further includes a float chamber case 12 internally defining a float chamber 11 in a lower part of the throttle body 2 corresponding to the venturi 4. The float chamber 11 stores the fuel to be supplied to the intake passage 3, and a prescribed fuel level is maintained in the float chamber 11 owing to a float valve not shown in the drawings.

In addition to the venturi 4 and the float chamber case 12, the carburetor 1 includes a main fuel passage 13 for supplying the fuel in the float chamber 11 to the venturi 4 of the intake passage 3, and a first and second main air passage 14, 15 for supplying air to the main fuel passage 13.

The main fuel passage 13 is formed by a fuel nozzle 16 which has a lower end (upstream end) 13*a* submerged in the fuel in the float chamber 11 and an upper end (downstream end) 13*b* opening out from a wall surface of the venturi 4. The lower end 13*a* of the main fuel passage 13 is provided with a main jet 13*j* consisting of a tubular member 17 fitted into the fuel nozzle 16 to narrow the cross sectional area of the main fuel passage 13.

The first main air passage 14 has an upstream end 14*a* opening out to the intake passage 3 of an intake passage member (not shown in the drawings) which is connected to the upstream end surface of the throttle body 2, a downstream end 14*b* connected to a part of the main fuel passage 13 on the downstream (upper) side of the main jet 13*j* and a first air jet 14*j* formed by a first tubular member 18 fitted in an intermediate part of the first main air passage 14. The first main air passage 14 is connected to the main fuel passage 13 so that the fuel flowing through the main fuel passage 13 is mixed with air and emulsified, thereby promoting the atomization of the fuel ejected from the upper end 13*b* of the main fuel passage 13 into the intake passage 3.

The second main air passage 15 has an upstream end 15*a* opening out to the intake passage 3 of an intake passage member (not shown in the drawings) which is connected to the upstream end surface of the throttle body 2, a downstream end 15*b* connected to a part of the first main air passage 14 on the downstream side of the a first air jet 14*j* and a second air jet 15*j* formed by a second tubular member 19 fitted in an intermediate part of the second main air passage 15.

The fuel nozzle 16, the first main air passage 14 and the second main air passage 15 jointly form a main mixture supply mechanism 20 for supplying fuel to the intake passage 3.

An air passage shaft 21 is provided in a part of the first main air passage 14 upstream of the junction with the second main air passage 15 and the first air jet 14*j* to selectively close and communicate the first main air passage 14. The air passage shaft 21 is coupled to the throttle valve 5 via a link mechanism 22 so that the air passage shaft 21 is angularly actuated in a certain relation with the angular position of the throttle valve 5 as will be discussed hereinafter. In other words, the link mechanism 22 functions as a switch mechanism for closing and communicating the first main air passage 14 depending on the engine load as will be described hereinafter.

Although not shown in the drawings, the carburetor 1 includes, in addition to the main mixture supply mechanism 20, a slow mixture supply mechanism for producing an air-fuel mixture during a low load operation in a stable manner. The slow mixture supply mechanism has a slow air passage having an upstream end communicating with an upstream part of the intake passage 3 and a downstream end communicating with the intake passage 3 at a point adjacent to the throttle valve 5 in the closed position and a point downstream to the throttle valve 5, and a slow fuel passage having a smaller cross sectional area than the main fuel passage 13 to supply fuel to the slow air passage. In an idling or low load operating condition, no fuel is ejected into the intake passage 3 from the fuel nozzle 16, and the mixture to be supplied to the intake passage 3 is produced by the fuel ejected into the slow air passage from the slow fuel passage. Thereby, even when the flow velocity of the intake air is low, a mixture with a stable air fuel ratio can be supplied to the engine.

Figure 2:
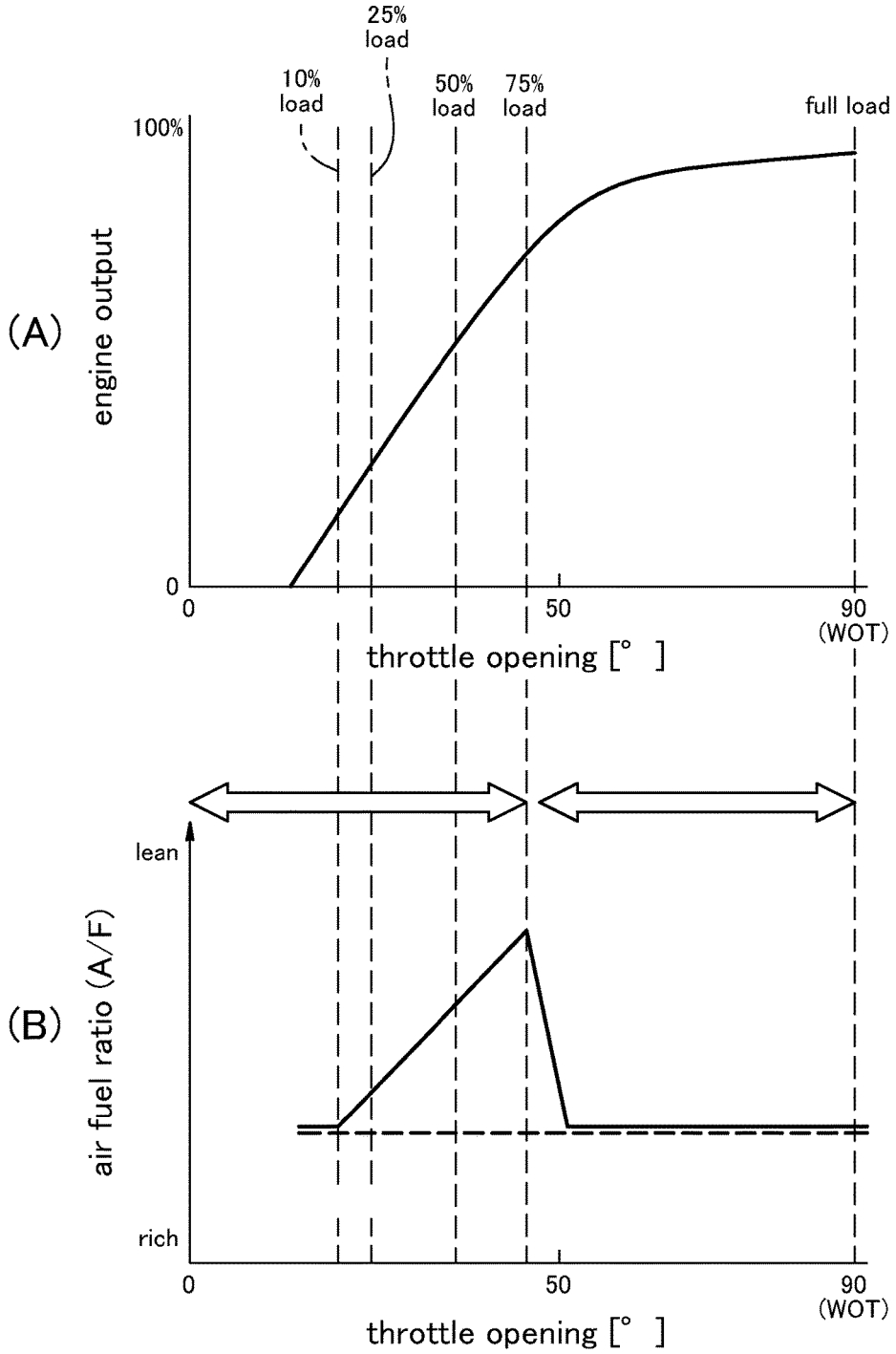
FIG. 2 is a graph showing (A) the relationship between the throttle opening and the engine output, and (B) the relationship between the throttle opening and the air fuel ratio.

The dependency of the engine output, the load factor and the air fuel ratio on the opening degree of the throttle valve (throttle opening) as well as the targeted air fuel ratio is discussed in the following with reference to FIGS. 2 and 3. FIG. 2(A) is a graph showing the relationship between the throttle opening and the engine output, and FIG. 2(B) is a graph showing the relationship between the throttle opening and the air fuel ratio. As shown in FIG. 2(A), the throttle opening changes from a fully closed position (zero degree) to a fully open position (WOT) over a range of 90 degrees, and the engine output increases with an increase in the throttle opening. The increase rate of the engine output for a given incremental increase in the throttle opening is relatively great or the inclination of the curve is great at a relatively small angle exceeding a prescribed angle (15 degrees, for instance). In a relatively large throttle opening region, the increase rate of the engine output for a given incremental increase in the throttle opening becomes smaller or the inclination of the curve gets smaller.

In FIG. 2(A), the load ratio is defined as the ratio of the current engine output to the engine output in a fully open throttle condition (WOT). In the example shown in FIG. 2(A), the load ratio is 10% when the throttle opening is 10 to 20 degrees, 25% when the throttle opening is 20 to 30 degrees, 50% when the throttle opening is 30 to 40 degrees, and 75% when the throttle opening is 40 to 50 degrees.

As shown in FIG. 2(B), in the low load operating condition where the engine load ratio is 0 to 25%, the fuel is supplied exclusively by the slow mixture supply mechanism so that the air fuel ratio is determined by the setting of the slow mixture supply mechanism. In the medium to high load operating condition where the engine load ratio is 25% or greater, the fuel is mainly supplied by the fast mixture supply mechanism so that the air fuel ratio is determined essentially by the setting of the fast mixture supply mechanism. FIG. 2 shows only an example, and this property may vary depending on the property of the internal combustion and the setting of the carburetor 1.

Figure 3:
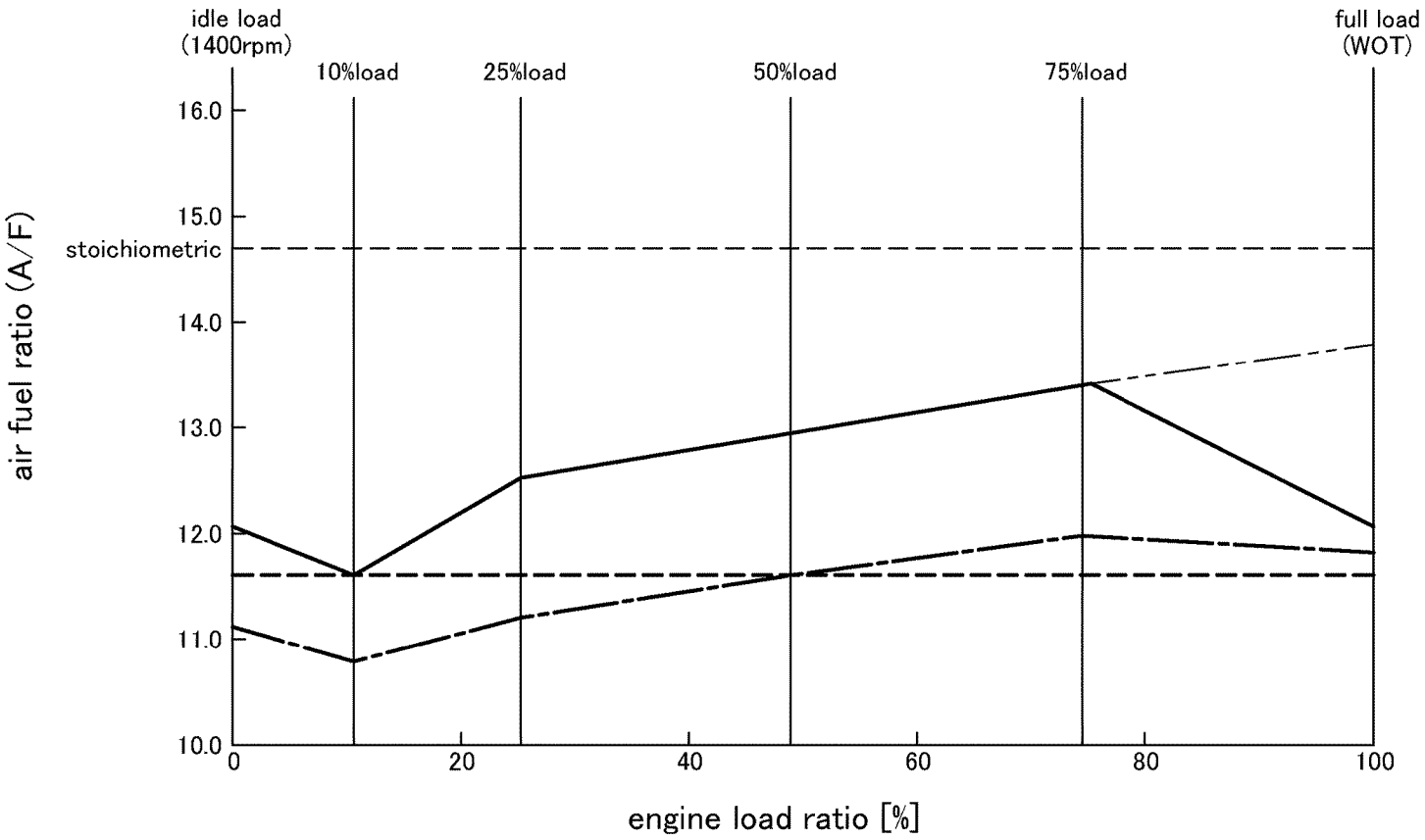
FIG. 3 is a graph showing the relationship between the engine load ratio and the air fuel ratio.

FIG. 3 is a graph showing the relationship between the engine load ratio and the air fuel ratio when the engine rotational speed is 3,060 rpm. In an ordinary carburetor, it is not possible to change the air fuel ratio in any selected part of the engine load ratio range. Therefore, the target air fuel ratio is constant over the entire engine load ratio range as indicated by the broken line in FIGS. 2(B) and 3. In view of fuel economy, it is preferable to select a leaner air fuel ratio (closer to the stoichiometric ratio of 14.7) as indicated by the double-dot chain dot line, but the engine output in the high load condition is impaired. In reality, it is difficult to maintain a constant air fuel ratio over the entire load range, and the air fuel ratio of a typical carburetor coincides with the target air fuel ratio only when the engine load ratio is 50%, becoming richer in the lower load range and leaner in the higher load range, as shown by the chain dot line in FIG. 3.

On the other hand, according to the illustrated embodiment, the fuel economy is improved in the medium load range (such as 25 to 75%), and the reduction in the engine output in the high load condition (such as 75% or higher) is avoided by making the air fuel ratio leaner in the medium load range and richer in the high load range as shown by the solid line in FIG. 3.

Such an air fuel ratio property can be achieved by making the air fuel ratio leaner than in the case of the conventional carburetor as the throttle opening is increased from a throttle opening range of 10 to 20 degrees (corresponding to the engine load ratio of 10%), and making the air fuel ratio richer as is the case with the conventional carburetor as the throttle opening is increased from a throttle opening range of 45 to 50 degrees (corresponding to the engine load ratio of 75%), as shown in FIG. 2(B).

Figure 4:
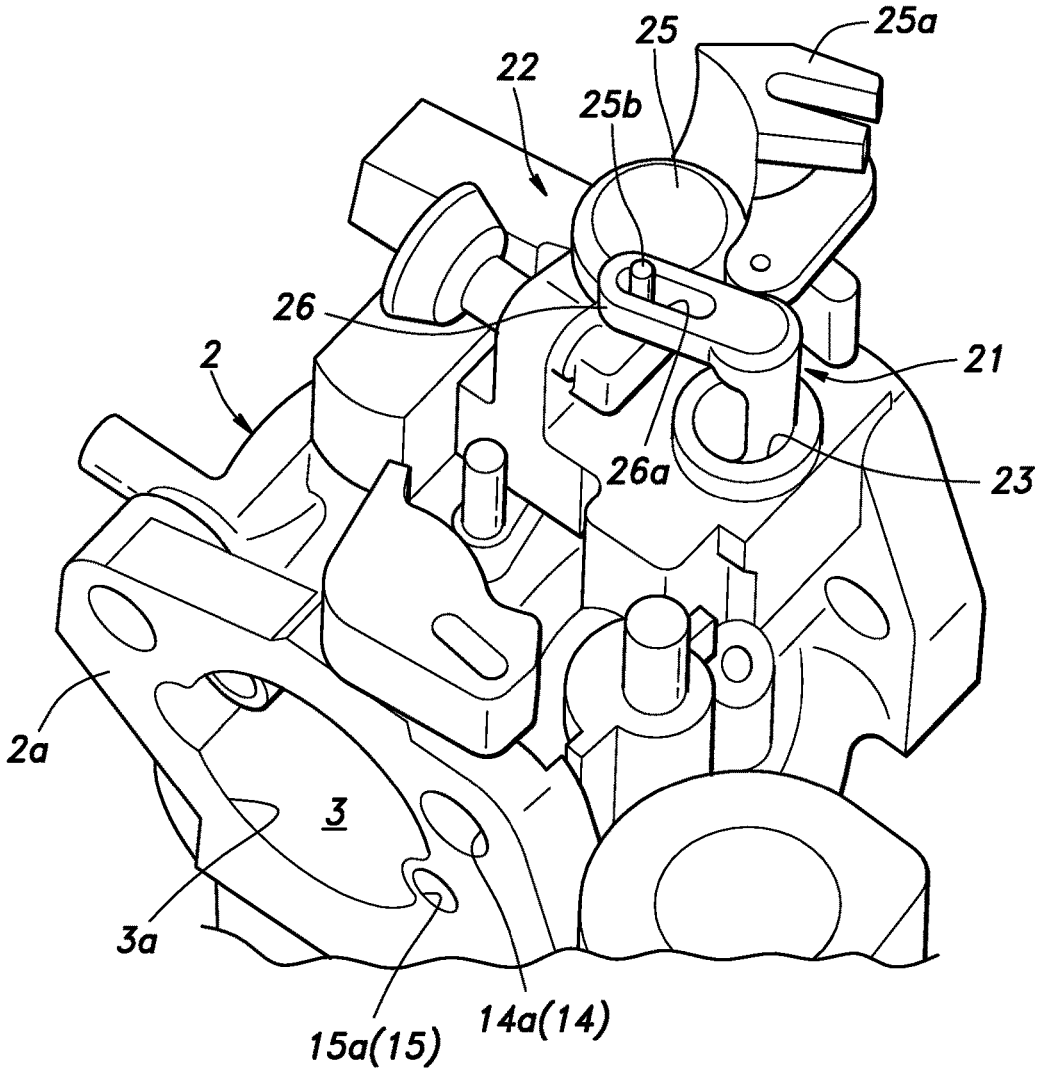
FIG. 4 is a perspective view of the carburetor shown in FIG. 1.
Figure 5:
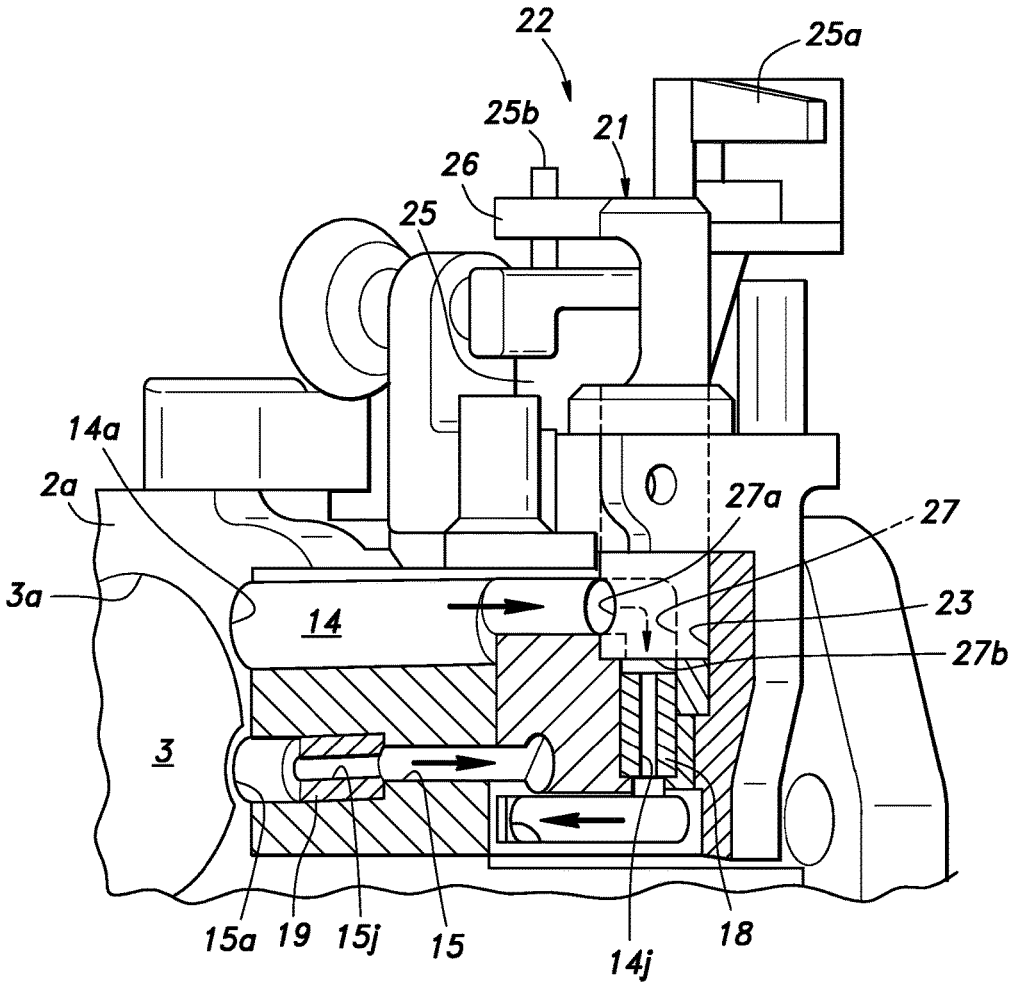
FIG. 5 is a perspective view of the carburetor partly in section.

The carburetor 1 fitted with the throttle body 2 according to the first embodiment is incorporated with a mechanism as illustrated in FIGS. 4 and 5 to achieve such an air fuel ratio property. The structure of this carburetor 1 is described in the following with reference to FIGS. 4 and 5.

The upstream end 3*a* of the intake passage 3 opens out at an upstream end surface 2*a* of the throttle body 2. Additionally, the upstream end 14*a* of the first main air passage 14 and the upstream end 15*a* of the second main air passage 15 open out at the upstream end surface 2*a* of the throttle body 2.

As shown in FIG. 5, the first main air passage 14 extends in parallel with the intake passage 3 beyond an intermediate part of the intake passage 3 of the throttle body 2, and communicates with a retaining hole 23 of the air passage shaft 21. An extension of the first main air passage 14 extends vertically downward from the bottom end of the retaining hole 23, and then extends in parallel with the intake passage 3 in the upstream direction. The first main air passage 14 further extends obliquely upward toward the venturi 4, and connected to the intermediate point of the main fuel passage 13 (or the nozzle 16). The vertical extension of the first main air passage 14 is fitted with a first tubular member 18. The first tubular member 18 may be inserted from the side of the retaining hole 23. The first tubular member 18 defines the first air jet 14*j* or a narrowest section of the first main air passage 14.

The second main air passage 15 extends in parallel with the intake passage 3 under the upstream part of the first main air passage 14, and is bent at a part corresponding to an intermediate part of the intake passage 3 to be connected to a part of the first main air passage 14 located more downstream than the first air jet 14*j*. The upstream part of the second main air passage 15 is provided with a stepped configuration including an upstream end having a relatively large diameter and a downstream end having a relatively small diameter. A second tubular member 19 is fitted into the large diameter part of the second main air passage 15, and abuts the annular shoulder surface defined at the boundary between the upstream end and the downstream end of the second main air passage 15. The inner diameter of the second tubular member 19 defines the second air jet 15*j* or a narrowest section of the second main air passage 15.

As shown in FIG. 4, the throttle shaft 7 (FIG. 1) is positioned in a laterally middle part of the downstream section of the intake passage 3, and extends vertically. The upper end of the throttle shaft 7 is integrally provided with an upper end cover member 25 and a throttle lever 25*a* projecting sideways from the upper end cover member 25. The upper end cover member 25 is further provided with an eccentric pin 25*b* projecting upward from the upper end cover member 25 in an eccentric relationship to the throttle shaft 7 so that the eccentric pin 25*b* undergoes a swinging movement around the axial center of the throttle shaft 7 in dependence on the opening angle of the throttle valve 5.

The air passage shaft 21 is rotatably received in the retaining hole 23 which is formed in a part of the throttle body 2 laterally offset from the intake passage 3 and slightly upstream of the throttle shaft 7, and extends in parallel with the throttle shaft 7. The upper end of the air passage shaft 21 is fixedly fitted with a radially extending arm 26 which is formed with a slot 26*a* elongated in the radial direction. The slot 26*a* receives the eccentric pin 25*b* in a slidable manner so that as the throttle valve 5 is pivoted, the resulting swinging movement of the eccentric pin 25*b* causes the air passage shaft 21 to rotate by a corresponding angle. Thus, the link mechanism 22 is formed by the eccentric pin 25*b* integrally provided on the throttle shaft 7 and the arm 26 extending from the air passage shaft 21 and provided with the slot 26*a* that engages the eccentric pin 25*b*.

As shown in FIG. 5, the air passage shaft 21 is formed with a cutaway (communication passage 27) in a lower part thereof to define a part of the first main air passage 14, and is passed into the retaining hole 23 formed in the upper end of the throttle body 2 from above. The communication passage 27 is bent in an intermediate part thereof in such a manner that an upstream end 27*a* of the communication passage 27 opens out on the outer circumferential surface of the air passage shaft 21 and a downstream end 27*b* of the communication passage 27 opens out on the lower axial end surface of the air passage shaft 21. The downstream end 27*b* of the communication passage 27 opens out toward the first air jet 14*j*.

The mode of operation of this throttle body 2, and the relationship between the opening angle of the throttle valve 5 and the positioning of the communication passage 27 are described in the following with reference to FIG. 6. As shown in FIG. 6(A), when the throttle valve 5 is fully closed (throttle opening zero), the upstream end 27*a* of the communication passage 27 (FIG. 5) formed in the air passage shaft 21 opens out to the upstream part of the first main air passage 14 so that the first main air passage 14 freely communicates from the upstream end 14*a* to the downstream end 14*b* (FIG. 1) thereof via the communication passage 27.

When the throttle opening is about 40 degrees, the opening area of the communication passage 27 facing the upstream part of the first main air passage 14 diminishes. The opening area in this case becomes smaller than the cross sectional area of the first air jet 14*j* as shown in FIG. 6(B). When the throttle opening increases to about 50 degrees, the communication between the communication passage 27 and the upstream part of the first main air passage 14 is shut off as shown in FIG. 6(C). In other words, the first main air passage 14 is blocked by the air passage shaft 21. When the throttle opening increases beyond the 50 degree angle, the air passage shaft 21 rotates further, but the first main air passage 14 remains to be blocked by the air passage shaft 21 as shown in FIG. 6(D). When the throttle opening is decreased from an angle greater than 50 degrees to zero degree, the air passage shaft 21 is rotated in the reverse direction, and the communication condition of the first main air passage 14 changes in the reverse order.

Figure 7:
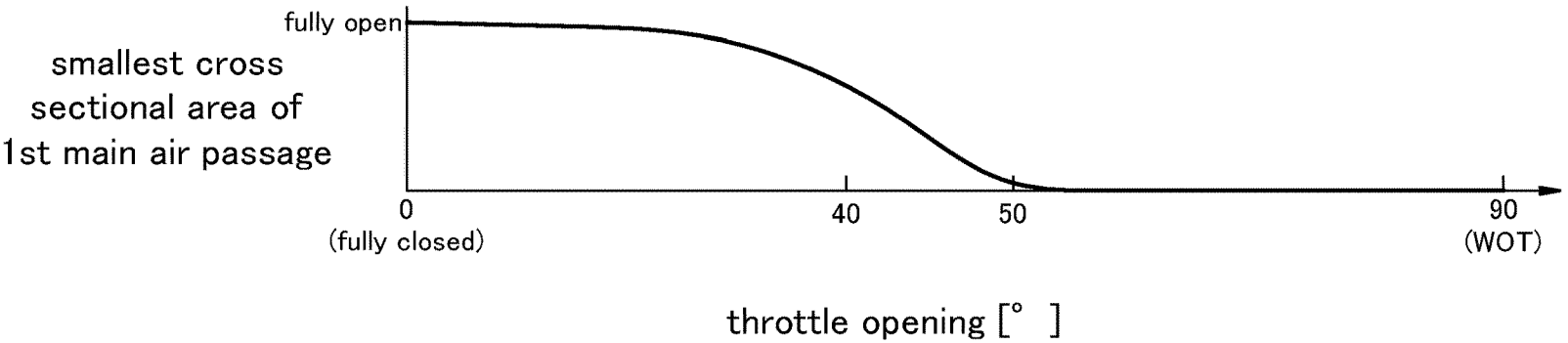
FIG. 7 is a graph showing the relationship between the smallest cross sectional area of the first main air passage and the throttle opening.

As shown in FIG. 7, the communication and the shut off condition of the first main air passage 14 is controlled by the air passage shaft 21 in dependence on the throttle opening in such a manner that the smallest cross sectional area of the first main air passage 14 is maximized (the cross sectional area of the second air jet 15*j*) when the throttle opening is 40 degrees or smaller, and is minimized (to zero value) when the throttle opening is 50 degrees or greater. Thus, when the throttle opening is 50 degrees or smaller, air is supplied to the main fuel passage 13 not only via the second main air passage 15 but also via the first main air passage 14 so that the fuel ejected to the intake passage 3 is reduced, and the air fuel ratio is made leaner. On the other hand, when the throttle opening is 50 degrees or greater, air is supplied to the main fuel passage 13 only via the second main air passage 15 and the downstream part of the first main air passage 14 so that the amount of the fuel ejected into the intake passage 3 is increased, and the air fuel ratio is made richer. In the illustrated embodiment, over the throttle opening range of about 40 degrees to 50 degrees, the communication condition of the first main air passage 14 changes gradually in relation to the change in the throttle opening, but the variable communication unit may also be configured such that the communication condition of the first main air passage 14 may change more abruptly in relation to the change in the throttle opening.

The mode of operation of the carburetor 1 described above is discussed in the following. The carburetor 1 includes a throttle body 2 internally defining the intake passage 3, the throttle valve 5 provided in the intake passage 3 for controlling the flow rate of air conducted by the intake passage 3, the main fuel passage 13 including the fuel nozzle 16 for supplying fuel to the intake passage 3, the first main air passage 14 communicating with the main fuel passage 13 to supply air to the main fuel passage 13, the air passage shaft 21 (serving as a variable communication unit) provided in a part of the first main air passage 14 and moveable between the open position for communicating the first main air passage 14 and the closed position for shutting off the first main air passage 14 and the link mechanism 22 (serving as a switch mechanism) for moving the air passage shaft 21 between the open position and the closed position in dependence on a load of the engine.

Thereby, the arrangement for adjusting the air fuel ratio by changing the air flow rate in the first main air passage 14 depending on the load of the engine can be realized in a highly simple manner. As the air passage shaft 21 is provided on the upstream side of the intake passage 3 with respect to the throttle valve 5, the length of the first main air passage 14 can be minimized so that the response delay for the adjustment of the air fuel ratio can be minimized. Because the positioning and the size of the air passage shaft 21 can be freely selected without being limited by the position of the throttle valve 5 and/or the diameter of the throttle shaft 7, a high level of freedom can be attained in the selection of the cross sectional area of the communication passage 27 in the air passage shaft 21. The properties discussed with reference to FIGS. 6 and 7 are merely exemplary, and may be changed for each particular carburetor 1 as desired. The switching point for the air passage is also not limited by the example given here, but may be changed so as to suit each individual application.

Figure 6:
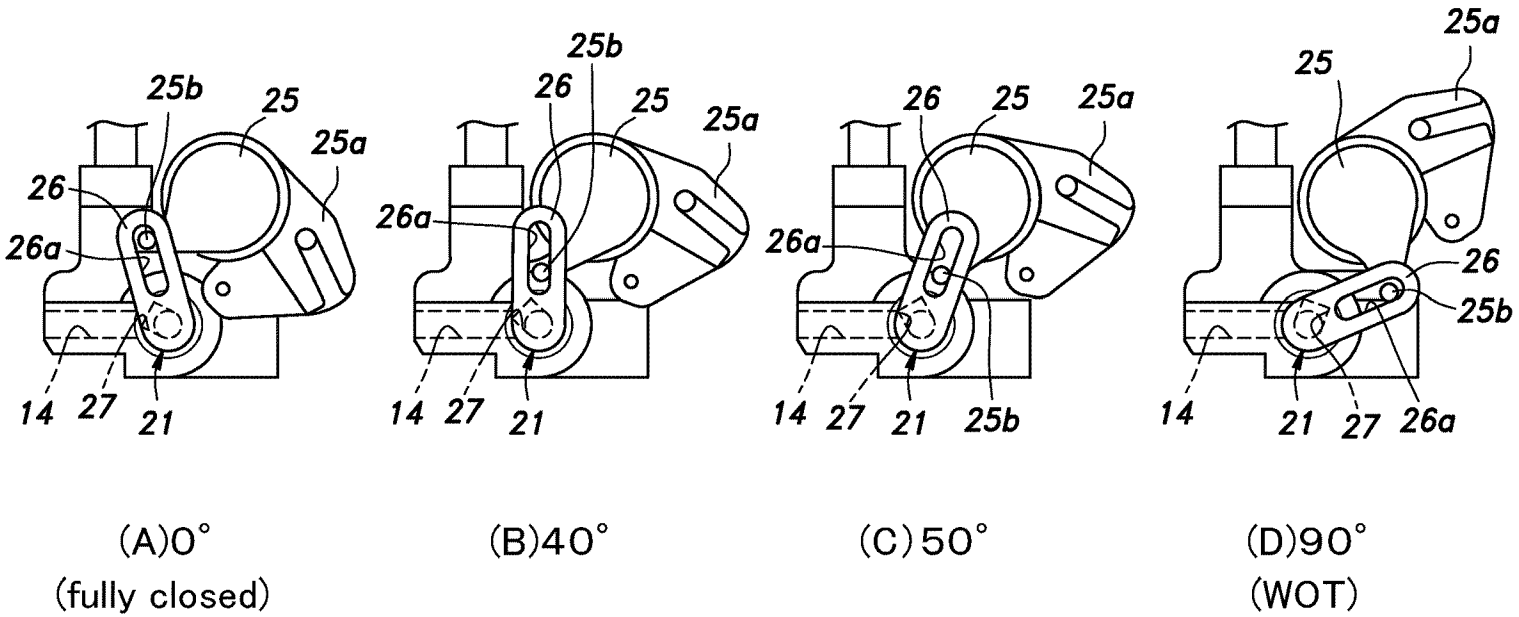
FIG. 6 is a diagram illustrating the mode of operation of the carburetor.

In the carburetor 1, as shown in FIG. 6, the air passage shaft 21 is actuated by the link mechanism 22 so as to shut off the first main air passage 14 in a high load operating condition, and communicate the first main air passage 14 in a low to medium load operating condition. Therefore, in the high load operating condition, the supply of air from the first main air passage 14 to the main fuel passage 13 is ceased so that the air fuel ratio is enriched, and the reduction of the engine output can be avoided.

As shown in FIGS. 1 and 5, the carburetor 1 of the illustrated embodiment further comprises the second main air passage 15 which communicates with a part of the first main air passage 14 downstream of the air passage shaft 21 to supply air to the main fuel passage 13 via the downstream part of the first main air passage 14. Therefore, even when the first main air passage 14 is shut off, a certain amount of air is still supplied to the main fuel passage 13 via the second main air passage 15 so that the atomization of the fuel is promoted at all times. Also, because air is supplied to the main fuel passage 13 via the second main air passage 15, even when there is any error in the setting of the cross sectional area of the communication passage 27 in the air passage shaft 21 and/or the switching timing of the air passage shaft 21, the air fuel ratio is not severely impacted by such an error. Therefore, no high precision is required in the manufacturing and installation of the air passage shaft 21, and the manufacturing cost can be minimized.

In the illustrated embodiment, the air passage shaft 21 is rotatable around an axial line in parallel with the throttle shaft 7, and defines the communication passage 27 forming a part of the first main air passage 14. The link mechanism 22 that couples the throttle valve 5 with the air passage shaft 21 is configured such that the first main air passage 14 is communicated via the communication passage 27 when the throttle opening is small, and is shut off by the air passage shaft 21 when the throttle opening is great. Thereby, a mechanism for adjusting the air fuel ratio can be realized in such a manner that the overall structure is simplified, and a high level of freedom in the layout design regarding the positioning and the size of the variable communication unit can be attained.

Furthermore, as shown in FIG. 4, the link mechanism 22 includes the eccentric pin 25*b* provided on the throttle shaft 7 and the arm 26 having the slot 26*a* receiving the eccentric pin 25*b* provided on the air passage shaft 21 so that the mechanism for actuating the air passage shaft 21 can be realized in a highly simple manner. Alternatively, the eccentric pin 25*b* may be provided on the air passage shaft 21 while the arm 26 having the slot 26*a* receiving the eccentric pin 25*b* is provided on the throttle shaft 7.

Second Embodiment

The carburetor 1 of the second embodiment is described in the following with reference to FIGS. 8 and 9. In the description of the second embodiment, the parts corresponding to those of the first embodiment are denoted with like numerals without necessarily repeating the description of such parts.

The carburetor 1 of this embodiment differs from the carburetor 1 of the first embodiment in the structure of the link mechanism 22. More specifically, the air passage shaft 21 is provided a further upstream part of the intake passage 3 as compared to the first embodiment. The upper end of the air passage shaft 21 is provided with a radially outwardly extending arm 31, and an eccentric pin 31*a* projects from the free end of the arm 31 in an eccentric relation to the air passage shaft 21. An end of a rod 32 is piovotally connected to the eccentric pin 31*a*, and the other end of the rod 32 is provided with a drive pin 32*a*. To the upper end of the throttle shaft 7 is fixedly attached a radially extending arm plate 33 which is provided with an arcuate concentric slot 33*a*. The drive pin 32*a* of the rod 32 is slidably received in this slot 33*a*. A torsion coil spring 34 is fitted around the eccentric pin 31*a* to urge the rod 32 in counter clockwise direction in FIG. 8 relative to the arm 31 so that the drive pin 32*a* is always urged against the radially outer edge of the arcuate concentric slot 33*a*.

This link mechanism 22 operates as discussed in the following. As shown in FIG. 8(A), when the throttle valve 5 is fully closed (throttle opening zero), the communication passage 27 opens out to the upstream part of the first main air passage 14 so that the first main air passage 14 is fully communicated via the communication passage 27.

As the throttle opening is increased from the fully closed position, the drive pin 32*a* is pushed against the outer edge of the arcuate concentric slot 33*a* because the drive pin 32*a* is urged against the outer edge of the arcuate concentric slot 33*a* by the torsion coil spring 34. At this time, the angle formed by the line connecting the centers of the throttle shaft 7 and the drive pin 32*a* less than 90 degrees, the outer edge of the arcuate concentric slot 33*a* pushes the rod 32 so that the arm 31 along with the air passage shaft 21 is turned in the counter clockwise direction via the eccentric pin 31*a*. But the communication passage 27 continues to open out to the upstream part of the first main air passage 14.

When the throttle opening reaches about 30 degrees, as shown in FIG. 8(B), the communication passage 27 still opens out to the upstream part of the first main air passage 14, but the opening area is smaller. When the throttle opening is about 50 degrees, as shown in FIG. 8(C), the communication between the communication passage 27 and the upstream part of the first main air passage 14 is disconnected. When the throttle opening is greater than 50 degrees, as shown in FIG. 8(D), the throttle valve 5 (throttle shaft 7) rotates further, but the air passage shaft 21 does not rotate any further because the drive pin 32*a* simply slides along the slot 33*a* because the angle formed by the line connecting the centers of the throttle shaft 7 and the drive pin 32*a* is 90 degrees or greater. Therefore, the blocked state of the first main air passage 14 by the air passage shaft 21 is maintained all the way to the fully open state of the throttle valve 5 (WOT).

When the throttle opening is decreased from the fully open state of the throttle valve 5 (WOT) to zero degree, the air passage shaft 21 is rotated in the reverse direction, and the communication condition of the first main air passage 14 changes in the reverse order.

By thus determining the relationship between the throttle opening and the communication state of the first main air passage 14 which is dictated by the angular position of the air passage shaft 21, the smallest cross sectional area of the first main air passage 14 is maximized (the cross sectional area of the second air jet 15*j*) when the throttle opening is 30 degrees or smaller, and is minimized (substantially to zero) when the throttle opening is 50 degrees or greater. When the throttle opening is 50 degrees or smaller, air is supplied to the main fuel passage 13 not only via the second main air passage 15 but also via the first main air passage 14 so that the air fuel ratio is made lean. On the other hand, when the throttle opening is 50 degrees or greater, air is supplied to the main fuel passage 13 only via the second main air passage 15 and the downstream part of the first main air passage 14 so that the amount of the fuel ejected into the intake passage 3 is increased, and the air fuel ratio is made richer.

Figure 8:
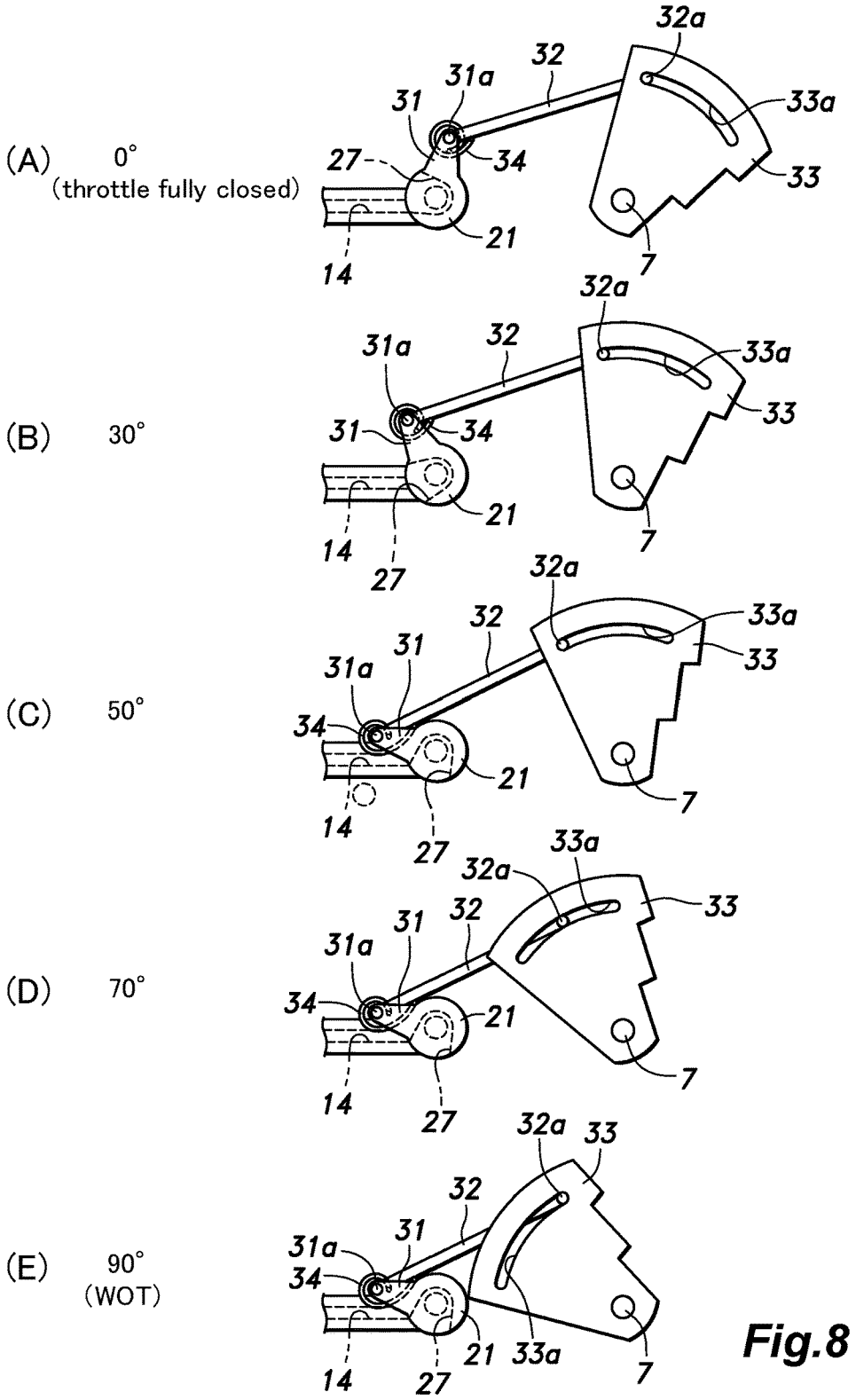
FIG. 8 is a diagram illustrating the mode of operation of a second embodiment of the present invention.
Figure 9:
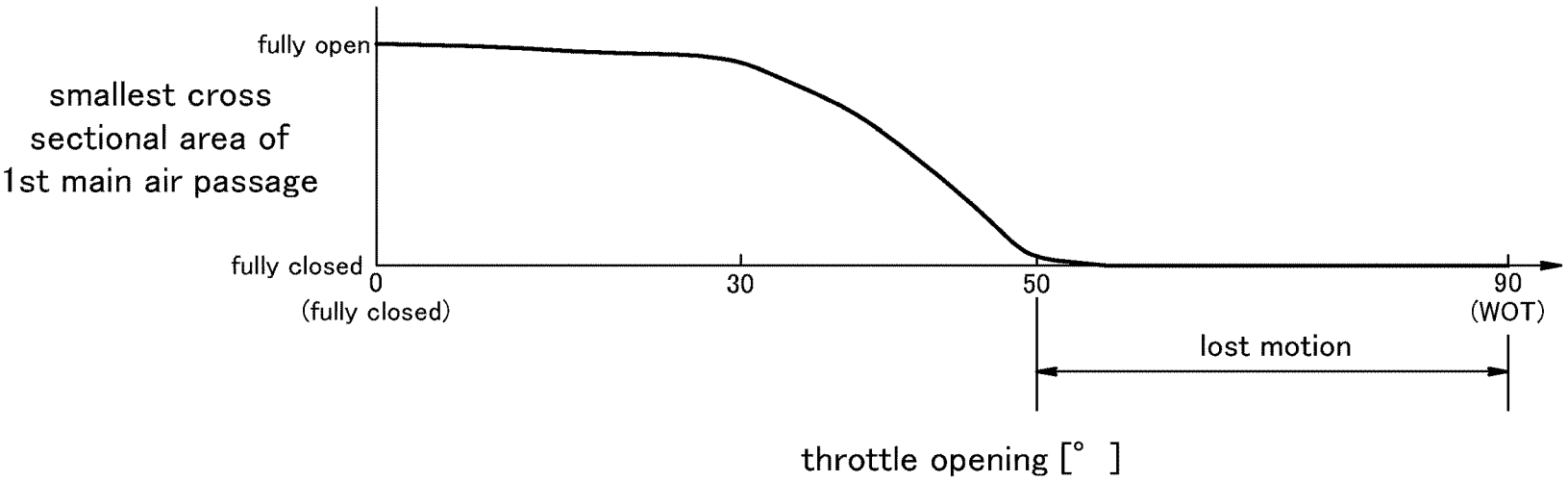
FIG. 9 is a graph showing the relationship between the smallest cross sectional area of the first main air passage and the throttle opening in the carburetor shown in FIG. 8.

Thus, in this embodiment, as shown in FIG. 8, the link mechanism 22 comprises the arm 31 fixedly attached to the upper end of the air passage shaft 21 and provided with the eccentric pin 31*a*, the rod 32 having an end pivotally connected to the eccentric pin 31*a* and the other end fitted with the drive pin 32*a*, the arm plate 33 fixedly attached to the upper end of the throttle shaft 7 and formed with the concentric slot 33*a* receiving the drive pin 32*a* in a slidable manner. Thereby, even when the air passage shaft 21 is located at some distance from the throttle shaft 7, the mechanism for actuating the air passage shaft 21 in dependence on the engine load can be realized with a simple structure. Because the air passage shaft 21 may be located significantly away from the throttle shaft 7, the length of the first main air passage 14 may be minimized, and the response delay of the air fuel ratio may be minimized. In other words, according to this embodiment, freedom in selecting the location of the air passage shaft 21 can be enhanced. The properties discussed with reference to FIGS. 8 and 9 are merely exemplary, and may be changed for each particular carburetor 1 as desired. The switching point for the air passage is also not limited by the example given here, but may be changed so as to suit each individual application.

Third Embodiment

The carburetor 1 of the third embodiment is described in the following with reference to FIG. 10. In the description of the third embodiment, the parts corresponding to those of the first embodiment are denoted with like numerals without necessarily repeating the description of such parts.

The carburetor 1 of this embodiment differs from the carburetor 1 of the first embodiment in the structures of the variable communication unit for selectively communicating (shutting off) the first main air passage 14 and the switch mechanism for selectively actuating the variable communication unit in dependence on the engine load condition. The positions of the first main air passage 14 and the second main air passage 15 of this embodiment are reversed in relation to those of the first embodiment as shown in FIG. 10, but this difference is not significant for the present invention.

The variable communication unit of this embodiment consists of a diaphragm 41 located in a part of the first main air passage 14 upstream of the junction with the second main air passage 15, and downstream of the first air jet 14*j*. The diaphragm 41 separates a part of the first main air passage 14 from a pressure chamber 42 such that the first air passage 14 is blocked when the pressure in the pressure chamber 42 is substantially equal to the atmospheric pressure. FIG. 10 shows the case where the pressure chamber 42 is under a negative pressure and the first main air passage 14 is communicated. The switching mechanism in this case consists of a negative pressure passage 43 having an end 43*a* communicating with a part of the intake passage immediately downstream of the throttle valve 5 and another end 43*b* communicating with the pressure chamber 42 for conducting the negative pressure to the pressure chamber 42.

Figure 10:
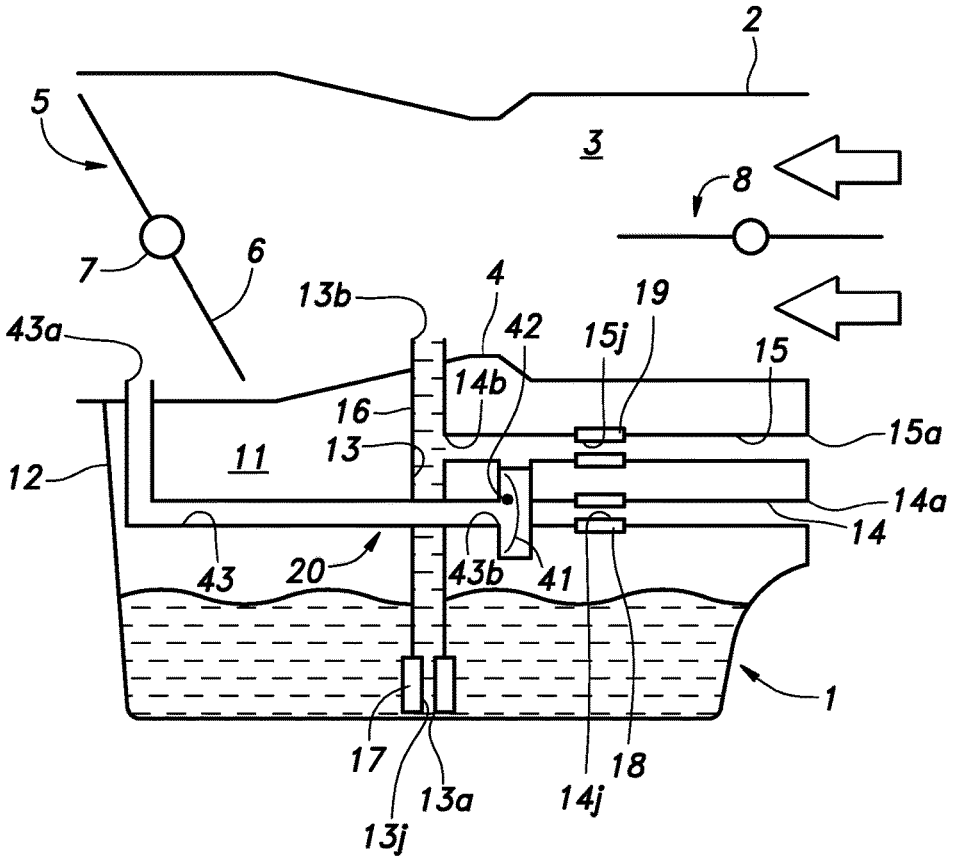
FIG. 10 is a view similar to FIG. 1 showing a third embodiment of the present invention.

As shown in FIG. 10, in a low to medium load condition where the opening angle of the throttle valve 5 is relatively small, the pressure chamber 42 is under a negative pressure so that the diaphragm 41 communicates the first main air passage 14. On the other hand, in a high load condition where the opening angle of the throttle valve 5 is relatively great, the pressure chamber 42 is under a pressure substantially equal to the atmospheric pressure so that the diaphragm 41 blocks the first main air passage 14. Thus the diaphragm 41 is caused to move in response to the opening angle of the throttle valve 5 by means of the negative pressure passage 43 which connects the pressure chamber 42 partly defined by the diaphragm 41 with the part of the intake passage 3 downstream of the throttle valve 5 where an intake negative pressure is produced depending on the throttle opening.

As can be appreciated from FIG. 10, the variable communication unit includes the diaphragm 41 that separates the pressure chamber 42 from a part of the first main air passage 14 in such a manner that the first main air passage 14 is communicated when the pressure chamber 42 in under negative pressure, and is blocked by the diaphragm 41 when the pressure chamber 42 is substantially under the atmospheric pressure, and the switch mechanism includes the negative pressure passage 43 communicating with a part of the intake passage 3 immediately downstream of the throttle valve 5 at the one end 43*a* and communicating with the pressure chamber 42 at the other end 43*b* for conducting the negative pressure of the intake passage 3 to the pressure chamber 42. Thereby, although a highly simple structure is used, the diaphragm 41 is made to respond to the intake negative pressure applied thereto via the negative pressure passage 43 such that the first main air passage 14 is communicated when the opening angle of the throttle valve 5 is small, and the intake negative pressure is significant, and blocks the first main air passage 14 when the opening angle of the throttle valve 5 is great, and the intake negative pressure is insignificant.

Fourth Embodiment

Figure 11:
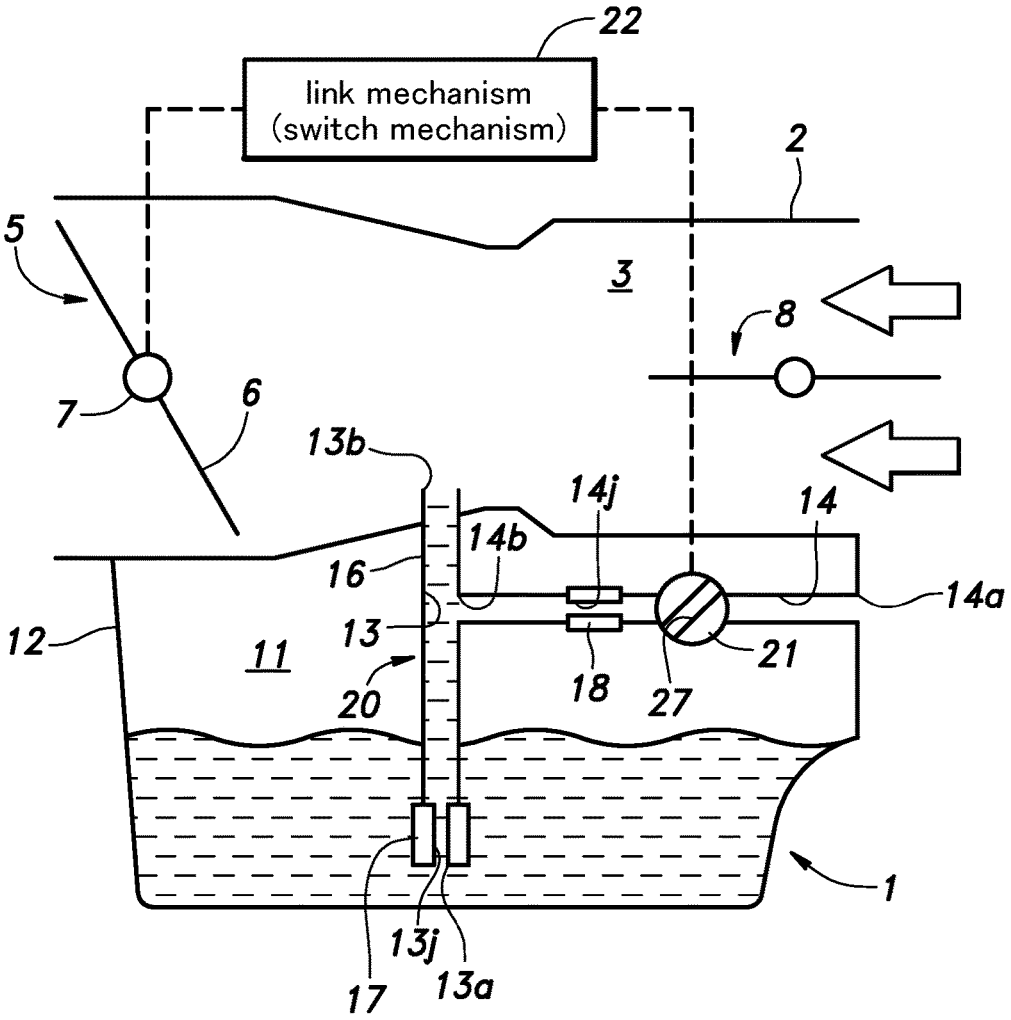
FIG. 11 is a view similar to FIG. 1 showing a fourth embodiment of the present invention.

The carburetor 1 of the fourth embodiment is described in the following with reference to FIG. 11. In the description of the fourth embodiment, the parts corresponding to those of the first embodiment are denoted with like numerals without necessarily repeating the description of such parts.

The carburetor 1 of this embodiment differs from the first embodiment in the absence of the second main air passage 15, but is otherwise similar to the first embodiment. This embodiment is not different from the first embodiment in that the air passage shaft 21 provided in the first main air passage 14 to serve as the variable communication unit is connected with the throttle valve 5 via the link mechanism 22 in such a manner that the air passage shaft 21 is actuated in response to the angular movement of the throttle valve 5. However, the positioning and the configuration of the communication passage 27 are different from those of the first embodiment because the amount of air supplied to the main fuel passage 13 is determined solely by the opening area of the air passage shaft 21 opening out to the upstream part of the first main air passage 14. If desired, the air passage shaft 21 and/or the communication passage 27 may be configured such that a small amount of air may be supplied to the main fuel passage 13 even substantially over the entire range of the throttle opening.

According to this embodiment, a higher level of manufacturing precision is required for the air passage shaft 21 and/or the communication passage 27, but the air fuel ratio can be controlled in a similar manner as the first embodiment.

The specific embodiments of the present invention have been described above, but the present invention is not limited by such embodiments, and can be modified in various ways without departing from the spirit of the present invention.

Glossary of Terms

| | | | |
|---|---|---|---|
| 1 | carburetor | 3 | intake passage |
| 4 | venturi | 5 | throttle valve |
| 7 | throttle shaft | 13 | main fuel passage |
| 14 | first main air passage (first air passage) | | |
| 15 | second main air passage (second air passage) | | |
| 20 | main mixture supply mechanism | | |
| 21 | air passage shaft (variable communication unit) | | |
| 22 | link mechanism (switch mechanism) | | |
| 25b | eccentric pin | 26 | arm |
| 26a | slot | 31a | eccentric pin |
| 32 | rod | 33 | arm plate |
| 33a | slot | | |
| 41 | diaphragm (variable communication unit) | | |
| 42 | pressure chamber | | |
| 43 | negative pressure passage (switch mechanism) | | |

The invention claimed is:

1. A carburetor for an internal combustion engine, comprising, a throttle body internally defining an intake passage;

a throttle valve provided in the intake passage for controlling a flow rate of air conducted by the intake passage, the throttle valve including a throttle shaft rotatably supported by the throttle body;

a fuel passage including a fuel nozzle for supplying fuel to the intake passage;

a first air passage communicating with the fuel passage to supply air to the fuel passage;

a variable communication unit provided in a part of the first air passage and moveable between an open position for communicating the first air passage and a closed position for shutting off the first air passage, the variable communication unit including an air passage shaft received in a retaining hole provided in an intermediate part of the first air passage in a rotatable manner around an axial line extending in parallel with the throttle shaft, the air passage shaft having a communication passage defined therein and being rotatable between the open position where the communication passage forms a part of the first air passage and the closed position where the communication passage forms no part of the first air passage; and a switch mechanism for rotating the air passage shaft between the open position and the closed position in dependence on a load of the engine, wherein the switch mechanism comprises a link mechanism coupled between the throttle shaft and the air passage shaft to rotate the air passage shaft such that the first air passage is communicated when an opening angle of the throttle valve is a first angle, and is shut off when the opening angle of the throttle valve is a second angle greater than the first angle, wherein the first air passage includes an upstream portion extending in parallel with the intake passage to the retaining hole of the air passage shaft, and a downstream portion extending from a bottom end of the retaining hole along an axis of the retaining hole and then is bent to extend to the fuel passage, and wherein the communication passage is bent in the air passage shaft and has an upstream end opening out in an outer circumference of the air passage shaft and a downstream end opening out in an inner end face of the air passage shaft.

2. The carburetor according to claim 1, further comprising a first tubular member fitted in a part of the downstream portion of the first air passage extending along the axis of the retaining hole such that the first tubular member defines a first air jet constituting a narrowest section of the first air passage.

3. The carburetor according to claim 2, further comprising a second air passage communicating with a part of the first air passage downstream of the first air jet to supply air to the fuel passage via the first air passage.

4. The carburetor according to claim 3, wherein the second air passage extends in parallel with the intake passage and is bent to be connected to the part of the first air passage downstream of the first air jet, and a part of the second air passage extending in parallel with the intake passage is provided with a stepped configuration including an upstream section having a first diameter and a downstream section having a second diameter smaller than the first diameter such that a shoulder surface is defined at a boundary between the upstream section and the downstream section, a second tubular member being fitted into the upstream section of the second air passage and positioned by abutting against the shoulder surface to define a second air jet constituting a narrowest section of the second air passage.

5. The carburetor according to claim 1, wherein the link mechanism includes an eccentric pin provided on one of the throttle shaft and the air passage shaft, and an arm provided on the other of the throttle shaft and the air passage shaft and having a slot receiving the eccentric pin.

6. The carburetor according to claim 1, wherein the link mechanism includes a rod connected eccentrically and pivotally to one of the throttle shaft and the air passage shaft at one end thereof, and an arm plate provided on the other of the throttle shaft and the air passage shaft and having a slot receiving an eccentric pin provided on another end of the rod.

7. The carburetor according to claim 1, wherein the link mechanism includes an eccentric pin provided on an outer end of the throttle shaft to be in parallel with the throttle shaft, and an arm provided on an outer end of the air passage shaft to extend radially with respect to the air passage shaft, the arm having a slot receiving the eccentric pin, such that when the throttle shaft rotates, the eccentric pin undergoes a swinging movement, and the swinging movement of the eccentric pin causes the air passage shaft to rotate via the arm in such a manner that when the throttle valve is fully closed, the first air passage is communicated by the air passage shaft.

8. The carburetor according to claim 7, wherein when the throttle valve is fully opened, the first air passage is shut off by the air passage shaft.

* * * * *